US006869254B1

(12) United States Patent
Kershman

(10) Patent No.: US 6,869,254 B1
(45) Date of Patent: Mar. 22, 2005

(54) RISER TENSIONER SENSOR ASSEMBLY

(75) Inventor: Martin L. Kershman, Houston, TX (US)

(73) Assignee: ElectroWaveUSA, Houston, TX (US)

( * ) Notice: Subject to any disclaimer, the term of this patent is extended or adjusted under 35 U.S.C. 154(b) by 0 days.

(21) Appl. No.: 10/691,460

(22) Filed: Oct. 22, 2003

Related U.S. Application Data

(60) Provisional application No. 60/420,709, filed on Oct. 23, 2002.

(51) Int. Cl.[7] ..... E21B 44/00

(52) U.S. Cl. ..... 405/224.4; 405/195.1; 405/224.2

(58) Field of Search ..... 405/224.4, 224.2, 405/195.1

(56) References Cited

U.S. PATENT DOCUMENTS 4,317,174 A * 2/1982 Dean ..... 405/195.1
4,883,387 A * 11/1989 Myers et al. ..... 405/224.4
5,628,586 A 5/1997 Arlt, III
5,658,095 A 8/1997 Arlt et al.
5,846,028 A 12/1998 Thory
6,296,232 B1 10/2001 Roodenburg
6,585,455 B1 * 7/2003 Petersen et al. ..... 405/224.4
6,748,809 B2 * 6/2004 Hanna et al. ..... 73/779

* cited by examiner

*Primary Examiner*—Frederick L. Lagman
(74) *Attorney, Agent, or Firm*—Harrison & Egbert

(57) ABSTRACT

An apparatus for providing an indication of relative movement between sheave assemblies of a riser tensioner that has a sensor target connectable to one of the sheave assemblies, a senor tube cooperative with said sensor target and suitable for interconnection to the other of the sheave assemblies, a metallic member positioned within the sensor tube and suspended by the sensor target, and a an ultrasonic sensor cooperative with the sensor tube so as to sense a distance that the metallic member moves within the sensor tube in relation to relative movement between the sensor target and the sensor tube.

20 Claims, 4 Drawing Sheets

RISER TENSIONER SENSOR ASSEMBLY

RELATED U.S. APPLICATIONS

The present application claims priority from U.S. Provisional Patent Application No. 60/420,709, filed on Oct. 23, 2002, and entitled "Riser Tensioner Sensor Assembly".

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to riser tensioner systems for use on offshore platforms and more particularly, to riser tensioner systems that absorb oscillatory vertical movements of the platform while supporting the riser. More particularly, the present invention relates to sensors associated with such riser tensioner systems. In particular, the present invention relates to such sensors that measure wear on the cable in the riser tensioner system and for showing the relative movement of the sheave assemblies used in such riser tensioner systems.

BACKGROUND OF THE INVENTION

Increased oil consumption has lead to exploration and drilling in difficult geographic locations that were previously considered economically unfeasible. As is to be expected, drilling under these difficult conditions leads to problems that are not present under more ideal conditions. For example, an increasing number of exploratory wells are being drilled in deep water, offshore locations in an attempt to locate more oil and gas reservoirs. These exploratory wells are generally drilled from floating platforms, leading to a set of problems peculiar to that environment.

As in any drilling operation, offshore drilling requires that drilling fluid must be circulated through the drill bit to cool the bit and to carry away the cuttings. This drilling fluid is normally delivered to the drill bit through the drill string and returned to the floating vessel through an annulus formed between the drill string and a large diameter pipe, commonly known as a riser. The riser typically stands between a subsea wellhead assembly and the floating vessel and is sealed against water intrusion.

The lower end of this riser is connected to the wellhead assembly adjacent the ocean floor, and the upper end usually extends through a central located opening in the hull of the floating vessel. The drill string extends longitudinally through the riser and into earth formations defined below the water, and drilling fluids circulates downwardly through the drill string, out through the drill bit, and then upwardly through the annular space between the drill string and the riser, thereby returning to the vessel.

As these drilling operations progress into deep waters, the length of the riser and, consequently, its unsupported weight also increases. Riser structural failure may result if compressive stresses is in the elements of the riser exceed the metallurgical limitation of the riser material. Riser tensioner systems are typically used to avoid this type of riser failure.

Riser tensioner systems are installed onboard the platform, and apply an upward force to the upper end of the riser, usually by means of cable, sheaves, and pneumatic cylinder mechanisms connected between the vessel and the upper end of the riser.

FIG. 1 illustrates one such type of a riser tensioner system as applied to a drilling vessel or drilling platform 1. The drilling vessel or drilling platform 1 comprises a mast 2, to which a drilling string 3 is fastened, which drilling string extends in the direction of the borehole (not shown). The drilling string 3 is virtually completely enclosed by a riser 4. A riser ring 5 is fastened at the top end of the riser 4. Cables 6, by means of which a tensile force can be exerted upon the riser 4, are fastened to the riser ring 5. Two cables 6 are shown in FIG. 1. In the prior art, it is customary to connect four, six, eight or twelve cables to the riser ring. The cable 6 extends from the riser ring 5 by way of sheaves 10, 11 and 12 in the direction of the cable anchor 13. When the drilling vessel or drilling platform 1 moves relative to the earth's surface, for example, as a result of wave action, the drilling vessel or drilling platform 1 will also move upwards relative to the riser 4. Since the sheaves 11 and 12 are situated on either side of a cylinder 14, these movements of the drilling vessel or drilling platform relative to the riser 4 can be absorbed. When the drilling vessel or drilling platform 1 moves relative to the riser 4, the cylinder 14 will be depressed, with the result that the distance between the sheaves 11 and 12 is reduced in the free end of the cable 6 between the sheave 10 and the riser-tensioner 5 will increase. When the drilling vessel or drilling platform 1 moves in the direction of the riser 4, the opposite will occur.

It is important in the use of such riser tensioners that the riser tensioner does not bottom cut during normal operation. In order to avoid this "bottoming out," the pressure of the pneumatic or hydraulic fluid within the riser tensioner can be increased or decreased, depending upon need. In order to determine the amount of pressure that must be applied to avoid this "bottoming out," it is important to continually monitor the relative movement between the sheaves 11 and 12 so that movement beyond a desired limit is avoided. For example, in rough sea conditions, it is important to increase the amount of pressure within the cylinder 14 so as to prevent the "bottoming out."

Throughout the motion of the riser tensioner, the cable is subjected to a great deal of wear and tear. Wear and tear is typically measured in terms of "ton-miles." To avoid cable failure after excessive usage, it is important to have a determination of the amount of wear applied to the cable over time. This measure will typically be based upon the amount of fluid pressure within the cylinder 14, and the total amount of movement of the cable over the sheaves 11 and 12 over a period of time.

It is an object of the present invention to provide a riser tensioner sensor system which can effectively provide an indication of cable wear.

It is another object of the present invention to provide a riser tensioner sensor which can continuously monitor relative movement of the sheave assemblies with respect to each other.

It is a further object of the present invention to provide a riser tensioner system which provides immediate and reliable feedback to the operator of the offshore platform.

It is still a further object of the present invention to provide a riser tensioner sensor system which is very durable, even in the extreme environmental conditions of the offshore oil platform.

It is a further object of the present invention to provide a riser tensioner sensor assembly which is easy to use, relatively inexpensive and easy to install.

These and other objects and advantages of the present invention will become apparent from a reading of the attached specification and appended claims.

BRIEF SUMMARY OF THE INVENTION

The present invention is a riser tensioner sensor assembly which can provide an indication of relative movement of the sheave assemblies associated with the riser tensioner, along with an indication of total wear on the cable supported by the sheave assemblies. In the present invention, a sensor target is interconnected to either a movable support or a fixed support of the riser tensioner. A sensor tube is in cooperative relation with the sensor target therein and is connected to the other of the movable support or the fixed portion of the riser tensioner. A sensor means is connected within the sensor tube so as to continually sense the distance that the sensor target moves vertically within the sensor tube. A processing means is connected to the sensor means and to the pressurizing system associated with the riser tensioner so as to provide a humanly perceivable measurement of the wear on the cable in the riser tensioner system.

In the present invention, the riser tensioner system includes a first sheave housing supporting a plurality of rotatable sheaves therein. A second sheave housing is also provided which supports a plurality of rotatable sheaves therein. A cable is threaded alternately over the sheaves of the first sheave housing and the sheaves of the second sheave housing. The cable will extend a distance therebetween. A compression means is interconnected between the sheave housings for resiliently connecting the first sheave housing to the second sheave housing. In particular, an inner tube is connected to the first sheave housing and received within an outer tube connected to the second sheave housing. A source of pneumatic pressure hydraulic pressure or pneumatic/hydraulic pressure is interconnected to the interior of these two tubular members so as to provide a suitable resistance to the movement of the first sheave housing with respect to the second sheave housing. A sensor or transducer can be associated with this pressurizing device so as to provide an indication of the amount of pressure within the riser tensioner system.

The sensor target of the present invention includes an annular member which is affixed to the first sheave housing so as to move in relation to the movement of the sheave housing. A magnet is received within the annular member. This magnet is a circular magnet having an inner diameter. The annular member has a wear surface positioned adjacent the inner diameter of the magnet. This wear surface is suitably replaceable and will ride in proximity to the exterior surface of the sensor tube. A support rod has one end affixed to the first sheave housing and an opposite end affixed to the annular member. This support rod extends transversely outwardly of the first sheave housing and of the riser tensioner.

The sensor tube is a tubular member which extends vertically and generally parallel relationship to the riser tensioner. The sensor tube extends through the interior of the annular member of the sensor target assembly. A spherical member is positioned interior of the sensor tube. This spherical member is made of a magnetically-attractive material, such as chrome-plated steel. The magnet of the sensor target suspends the spherical member within the sensor tube. As a result, the spherical member is movable interior of the sensor tube relative to the movement of the sensor target along the sensor tube. The magnetic attraction of the magnet with respect to the spherical member will continually support the spherical member interior of the sensor tube in a suspended orientation.

A base is connected to the bottom of the sensor tube. This base is affixed to the outer tube of the riser tensioner (or some other surface that is fixed relative to the movement of the first sheave housing). In particular, a plate extends outwardly of the outer tube of the riser tensioner. The base is affixed to a top of this plate. A flex coupling is interposed between the base and the top of the plate.

A sensor means is connected to the base and is directed upwardly into the interior of the sensor tube. The sensor means is for measuring movement of the spherical member within the sensor tube. The sensor means is an ultrasonic sensor which is interactive with the spherical member. The processing means connected to the sensor means for the purpose of measuring relative movement of the sheave housings with respect to each other. Processing means is also connected to the pressurizing device associated with the riser tensioner. The information is suitably processed so as to provide a humanly perceivable measurement of the wear on the cable. The wear is measured and displayed on a readout instrument. Suitable algorithms are urged to process data so as to determine cable wear.

DETAILED DESCRIPTION OF THE INVENTION

Figure 1:
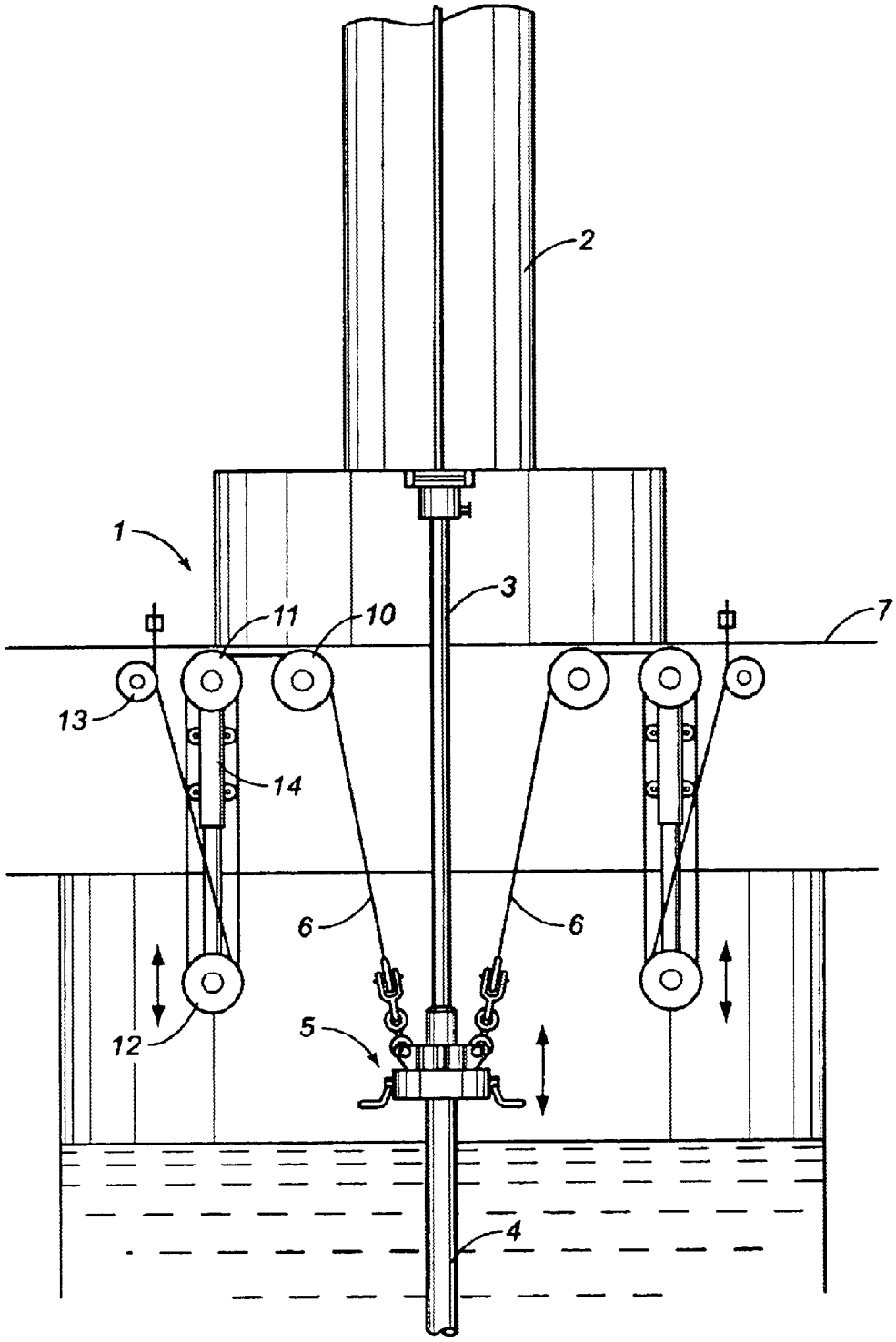
FIG. 1 Prior Art
FIG. 1 is a diagrammatic illustration of a prior art riser tensioner system.
Figure 2:
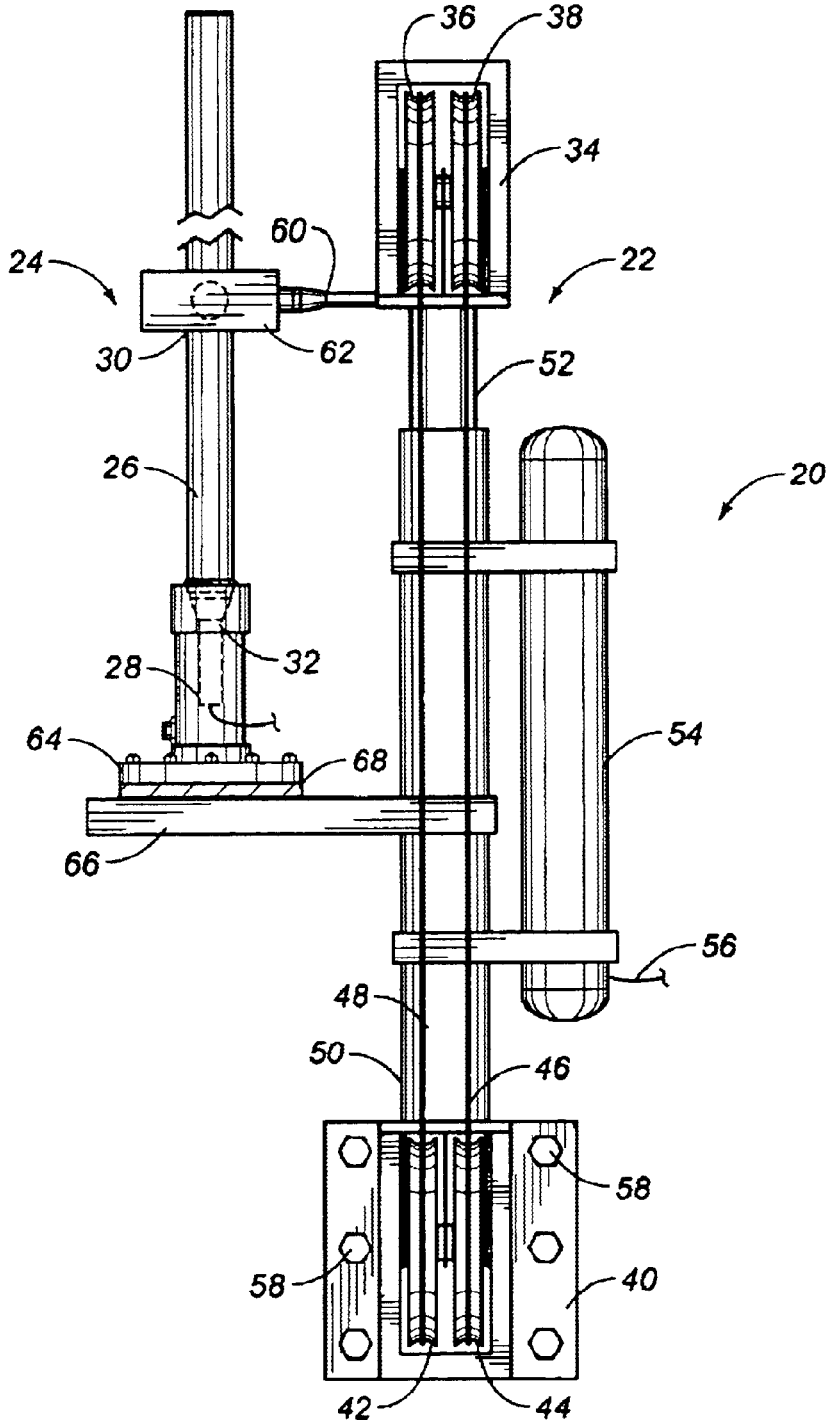
FIG. 2 is a diagrammatic illustration of the riser tensioner sensor assembly of the present invention.

Referring to FIG. 2, there is shown the riser tensioner sensor assembly 20 in accordance with the teachings of the preferred embodiment of the present invention. The assembly includes a riser tensioner system 22, a sensor target 24, a sensor tube 26, and a base 28 supporting the sensor tube 26 in a substantially vertical orientation. A spherical member 30 is illustrated as suspended within an interior of the sensor tube 26 by the action of the sensor target 24. The sensor 32 is directed upwardly toward the interior of the sensor tube 26 so as to provide an indication of the relative movement of the spherical member 30 within the tube 26 over a period of time.

In the present invention, the riser tensioner system 22 includes a first sheave housing 34 supporting a plurality of sheaves 36 and 38 therein. A second sheave housing 40 supports a plurality of sheaves 42 and 44 therein. A cable 46 is threaded alternately over the sheaves 36, 42, 38, and 44 of the sheave housings 34 and 40. A compression system 48 extends between the first sheave housing 34 and the second sheave housing 40 so as to maintain the sheave housings 34 and 40 in a desired position away from each other and to flexibly maintain the sheave housings 34 and 38 in relationship to each other. The compression system 48 is a piston-and-cylinder assembly in which an outer tube 50 forms the cylinder and a second tube 52 acts as a piston rod extending outwardly of the outer tube 50. A pressurizer 54 is in fluid communication with the compression system 48 so as to suitably pressurize the piston-and-cylinder assembly for the purpose of maintaining the first sheave housing 34 in the desired position with respect to the second sheave housing 40 for the purpose of flexibly connecting the sheave housings 34 and 40 and for preventing any "bottoming out" of the riser tensioner system. The pressurizing device 54 is a source of pneumatic pressure that can adjustably introduce a desired amount of pressure within the interior of the compression system 48. A transducer line 56 is connected to the pressurizing device 54 for the purpose of activating the pressurizing device 54 so as to increase or decrease pressure therefrom and also for the purpose of providing a numerical reference as to the amount of pressure that has been introduced into the compression system 48.

As can be seen in FIG. 2, the second sheave housing 40 has suitable bolts 58 which allow the second sheave housing 40 to be suitably fixedly attached to the offshore platform or to a fixed position on the offshore platform. It can also be seen in FIG. 2 that the cable 46 extends as a pair of lines between the respective sheaves. As stated earlier, a larger number of sheaves can also be provided for the purposes of the riser tensioner system.

The sensor target 24 has a support structure 60 affixed to the first sheave housing 44 and extending transversely outwardly therefrom. Support structure 60 is connected to an annular member 62 positioned over and around the sensor tube 26. As will be described hereinafter, the annular member 62 supports a circular magnet therein so that the inner diameter of the magnet is adjacent to the outer surface of the sensor tube 26. A suitable wear surface can be interposed between the magnet and the outer surface of the sensor tube 26.

The base 28 supports the sensor tube 26 in a generally vertically upright orientation in parallel relationship to the riser tensioner 22. The base 28 also supports the sensor 32 therein. The base 28 has a bottom flange 64 affixed to a plate 66. A flex coupling 68 is interposed between the bottom of flange 64 and the top surface of plate 66 so as to allow flexibility between the base 28 (and its support of sensor tube 26) and angular deflection caused by the movement of the riser tensioner system 22. The plate 66 is affixed to the outer tube 50 of the compression system 48. In other words, plate 66 will be in a fixed transverse orientation in generally parallel relationship to the movable support structure 60 and its associated sensor target assembly 24.

The sensor 32 is an ultrasonic sensor that is manufactured by Senix Corporation. The sensor 32 rapidly and accurately measures the distance to target materials without contact. The sensor 32 is directed toward the spherical member 30 so as to measure the distances that the spherical member 30 moves within the sensor tube 26.

Figure 3:
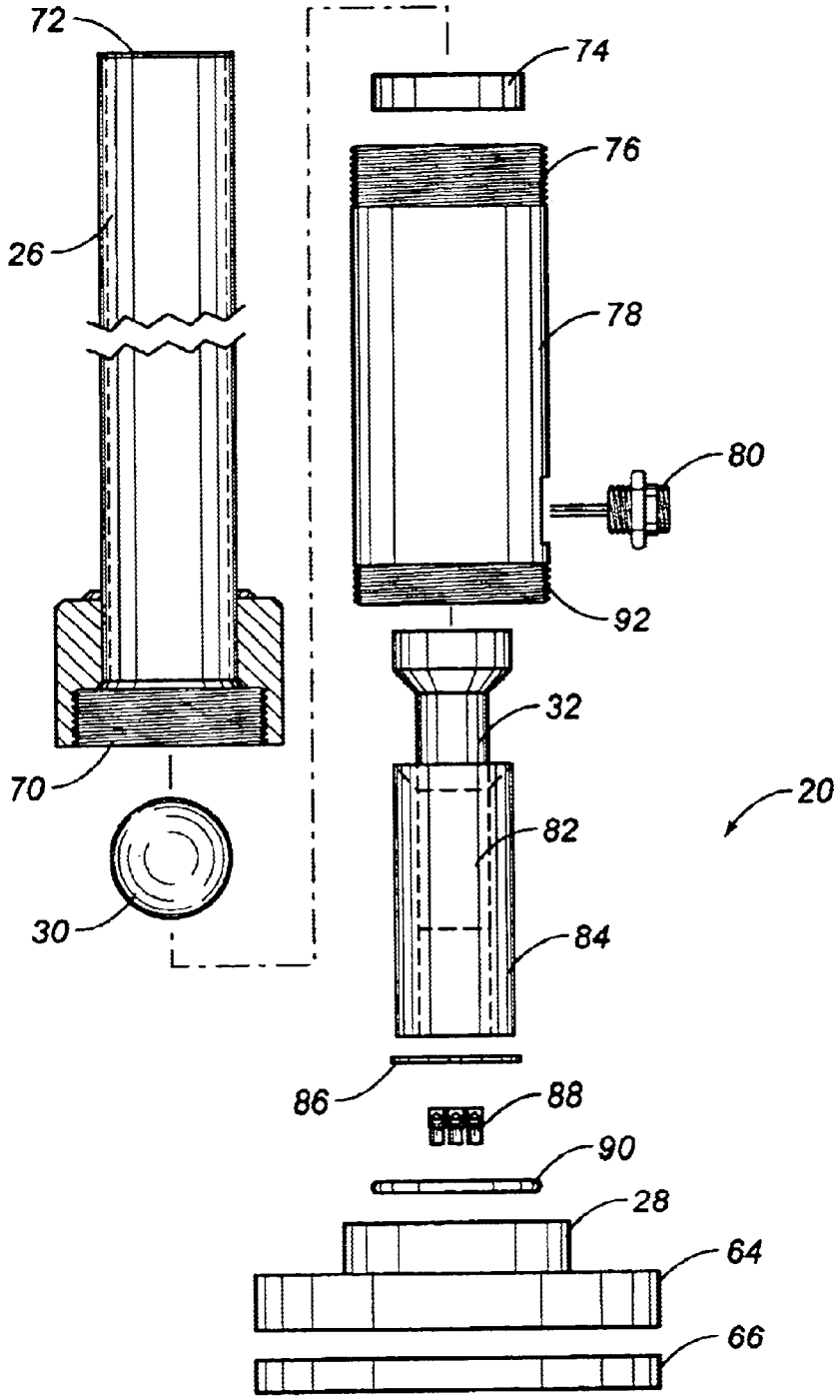
FIG. 3 is an exploded view of the riser tensioner sensorassembly of the present invention.

FIG. 3 is an exploded view of the riser tensioner sensor assembly 20 of the present invention. Initially, it can be seen that the sensor tube 26 is a stainless steel tube having a threaded bottom 70. The sensor tube 26 has an inner diameter which is less than the diameter of the spherical member 30. A plate 72 is welded to the top end of the sensor tube 26 so as to prevent liquid intrusion thereinto.

The spherical member 30 is a chrome-plated steel ball. The spherical member 30 is suitably chrome-plated so as to resist corrosion in the harsh environment of the offshore platform. This steel should be of a suitable grade so as to be magnetically attractive to the magnet supported by the annular member of the sensor target. Since the spherical member 30 is properly spherical, it will not "hang up" on any surfaces formed on the interior of the sensor tube 26. A DELRON™ ring 74 is interposed between the threaded portion 70 of the sensor tube 26 and the externally threaded area 76 of sensor housing 78. As such, a liquid-tight seal can be properly established between the sensor tube 26 and the sensor housing 78. A connector 80 is illustrated as positioned within a wall of the sensor housing 78 so as to be connected to the sensor 32. The sensor 32 is inserted into the interior of the sensor housing 78. In particular, the handle end 82 of sensor 30 is positioned within a DELRON™ sleeve 84. The DELRON™ sleeve 84 will establish a liquid-tight containment within the interior of the sensor housing 78. A retaining ring 86 is then positioned at the end of the DELRON™ sleeve 84. An in-line term block 88 is then installed with connector 80 onto the end of the sensor 32. O-ring seal 90 is then positioned interior of the open end of the base 28 so as to establish further a liquid-tight seal between the lower threaded end 92 of the sensor housing 78 and the internally threaded base 28. Bottom flange 64 extends outwardly of the base 28 at the bottom thereof. Flex coupling 68 is then positioned below the bottom flange 64.

Figure 4:
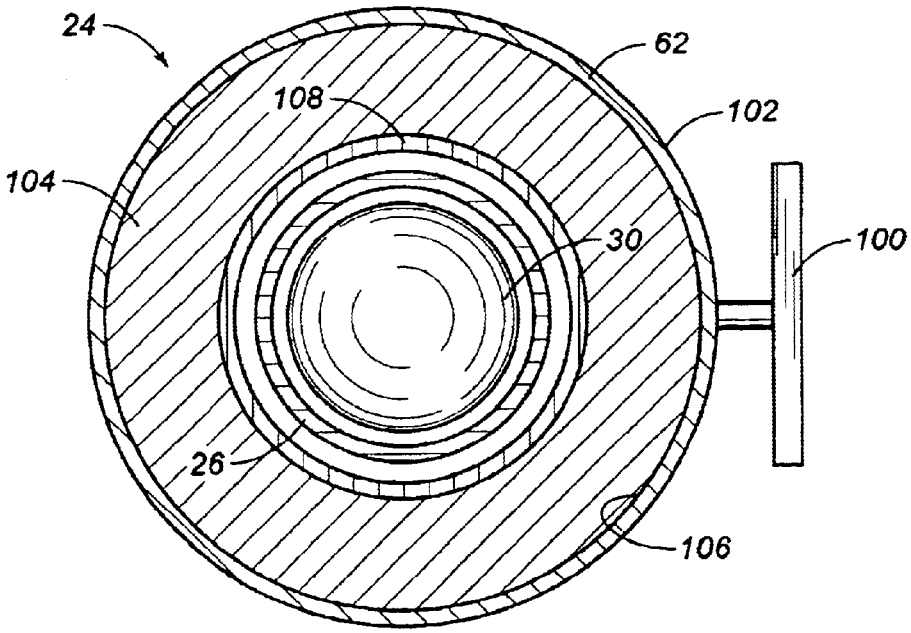
FIG. 4 is a cross-sectional view showing the sensor target as positioned over the sensor tube and around the spherical member associated with the sensor assembly of the present invention.

FIG. 4 shows a cross-sectional view of the sensor target 24 of the present invention as positioned to support the spherical member 30 in a desired position within the sensor tube. Initially, a bracket 100 is connected to the support structure 60. Bracket 100 extends outwardly from the outer wall 102 of the annular member 62. Annular member 62 has an interior area into which the magnet 104 is positioned. The magnet 104 can be secured within the interior of the annular member 62 in a variety of ways, such as bolting, adhesives, fasteners or other devices. The magnet 104 is positioned between the inner wall 106 of the annular member 62 and the outer wall of the wear surface 108. Wear surface 108 is an annular member which is interposed between the magnet 104 and the outer surface of the sensor tube 26. The wear surface 108 can be a TEFLON™ ring which can be replaceably positioned on the interior surface of the magnet 104. The purpose of the wear surface 108 is to provide a contact surface between the outer surface of the sensor tube 26 and to prevent damage to the magnet 104. After a desired period of time, the wear surface 108 can be suitably replaced.

In FIG. 4, it can be seen that the spherical member 30 is supported in suspended relation within the interior of the sensor tube 26. The strong magnetic forces imparted by the magnet 104 will suspend the steel ball 30 within the sensor tube 26. Because of the spherical nature of the spherical member 30, minimal contact will occur between the spherical member 30 and the inner wall of the sensor tube 26. Additionally, the spherical nature of spherical member 30 will avoid any "hanging up" of the member 30 during its up-and-down movement within the sensor tube 26.

In normal use, the sensor 32 can be connected to a computer system for the processing of information as to the relative movement of the sheave housing 34 of the riser tensioner system 22. As such, the riser tensioner system 22 can be continually monitored so as to properly set the pressure within the compression system 48 so as to avoid "bottoming out" and to conform the riser tensioner system 22 to environmental conditions. The computer system can calculate the amount of travel of the cable 46 during the up and down movement of the sheave housing 34. As a result, in combination with the pressure provide from the pressurizing device 54, the system of the present invention can determine the wear on the cable 46 over time.

The foregoing disclosure and description of the invention is illustrative and explanatory thereof. Various changes in the details of the illustrated configuration can be made within the scope of the following claims without departing from the true spirit of the invention. The present invention should only be limited by the following claims and their legal equivalents.

I claim:

1. An apparatus comprising:

a riser tensioner having a movable support and a fixed support;

a sensor target interconnected to one of said movable support and said fixed support of said riser tensioner;

a sensor tube cooperative with said sensor target, said sensor tube being interconnected to the other of said movable support and said fixed support of said riser tenioner; and a sensoring means cooperative with said sensor tube, said sensor means for sensing a distance that said sensor target moves within said sensor tube.

2. The apparatus of claim 1, further comprising:

a processoring means connected to said sensor means for providing a humanly perceivably measurement of wear on a cable extending on said riser tensioner.

3. The apparatus of claim 1, said riser tensioner comprising:

a first sheave housing supporting a plurality of rotatable sheaves thereon;

a second sheave housing supporting a plurality of rotatable sheaves thereon; and a cable threaded over said plurality of rotatable sheaves of said first sheave housing and over said plurality of rotatable sheaves of said second sheave housing.

4. The apparatus of claim 3, said riser tensioner further comprising:

a compressing means interconnected between said first and second sheave housings, said compressing means for resiliently connecting said first sheave housing to said second sheave housing.

5. The apparatus of claim 4, said riser tensioner further comprising:

an inner tube connected to said first sheave housing; and an outer tube connected to said second sheave housing, said inner tube resiliently received within said outer tube, said compressing means being a source of hydraulic or pneumatic pressure supplied to an interior of said inner tube and said outer tube so as to provide a resistance to movement of said first sheave housing with respect to said second sheave housing.

6. The apparatus of claim 1, said sensor target comprising:

an annular member interconnected to said riser tensioner so as to move relative to a movement of said movable support with respect to said fixed support;

a magnet received within said annular member; and a metallic member positioned interior of said sensor tube, said magnet magnetically suspending said metallic member within said sensor tube.

7. The apparatus of claim 6, said magnet being a circular magnet having an inner diameter, said circular magnet extending entirely around a circumference of said sensor tube.

8. The apparatus of claim 7, further comprising:

a wear surface resiliently affixed to said inner diameter of said circular magnet so as to be interposed between said circular magnet and said sensor tube.

9. The apparatus of claim 6, further comprising:

a support rod having one end affixed to said movable support and an opposite end affixed to said annular member, said support rod extending horizontally outwardly ofsaid annular member.

10. The apparatus of claim 6, said metallic member being sphere formed of a material magnetically attractive to said magnet.

11. The apparatus of claim 5, further comprising:

a base affixed to a surface of said sensor tube and secured to a surface that is fixed relative to a movement of said movable support.

12. The apparatus of claim 11, said surface being a plate affixed to said outer tube and extending therefrom, said base being connected to said plate, the apparatus further comprising:

a flex coupling interposed between said base and a top of said plate so as to provide a flexible connection between said sensor tube and said plate.

13. The apparatus of claim 1, said sensing means connected to a bottom of said sensor tube and directed upwardly within said sensor tube.

14. The apparatus of claim 13, said sensor target comprising:

a spherical member movable positioned within said sensor tube, said spherical member movable within said sensing tube relative to a relative movement of said fixed support with respect to said movable support, said sensor means being an ultrasonic sensor, said ultrasonic sensor being interactive with said spherical member.

15. A sensor apparatus for providing an indication of relative movement between sheave assemblies of a riser tensioner system, the sensor apparatus comprising:

a sensor target suitable for interconnection to one of the sheave assemblies;

a sensor tube cooperative with said sensor target, said sensor tube suitable for interconnection to the other of the sheave assemblies;

a metallic member positioned within said sensor tube and suspended by said sensor target, said metallic member being movable within said sensor tube in relation to relative movement between said sensor target and said sensor tube; and a sensing means cooperative with said sensor tube, said sensing means for sensing a distance at said metallic member moves in said sensor tube.

16. The sensor apparatus of claim 15, said sensor target comprising:

an annular member;

a magnet received within said annular member, said magnet positioned relative to said sensor tube so as to suspend said metallic member within said sensor tube.

17. The sensor apparatus of claim 16, said magnet being a circular magnet having an inner diameter, said circular magnet extending outwardly around a circumference of said sensor tube, said circular magnet having a wear surface removably affixed to said inner diameter of said circular magnet so as to be interposed between said circular magnet and said sensor tube.

18. The sensor apparatus of claim 16, said metallic member being sphere formed of a material magnetically attractive to said magnet.

19. The sensor apparatus claim 15, said metallic member comprising:

a spherical member movably positioned within said sensor tube, said spherical member movable within said sensor tube relative to a relative movement between the sheave assemblies of the riser tensioner, said sensing means being an ultrasonic sensor, said ultrasonic sensor being connected to a bottom of said sensor tube and directed upwardly within said sensor tube so as to be interactive with said spherical member.

20. The sensor apparatus of claim 15, further comprising:

a processing means connected to said sensing means for providing a humanly perceivable measurement of wear on a cable extending around the sheave assemblies of the riser tensioner.

* * * * *